United States Patent [19]

Mitarai

[11] Patent Number: 4,534,257

[45] Date of Patent: Aug. 13, 1985

[54] ELECTRONIC MUSICAL INSTRUMENT

[75] Inventor: Tsuyoshi Mitarai, Yokohama, Japan

[73] Assignee: Casio Computer Co., Ltd., Tokyo, Japan

[21] Appl. No.: 644,666

[22] Filed: Aug. 27, 1984

Related U.S. Application Data

[63] Continuation of Ser. No. 432,998, Oct. 6, 1982, abandoned.

[30] Foreign Application Priority Data

Oct. 9, 1981 [JP] Japan ..... 56-161411

[51] Int. Cl.[3] ..... G10H 1/38; G10H 1/40; G10H 7/00

[52] U.S. Cl. ..... 84/1.03; 84/DIG. 12; 84/DIG. 22

[58] Field of Search ..... 84/1.03, 1.01, 1.17, 84/1.24, DIG. 12, DIG. 22

[56] References Cited

U.S. PATENT DOCUMENTS

| | | | |
|---|---|---|---|
| 3,882,751 | 5/1975 | Tomisawa et al. . | |
| 4,085,644 | 4/1978 | Deutsch et al. . | |
| 4,174,649 | 11/1979 | Obayashi et al. . | |
| 4,179,970 | 12/1979 | Faulkner . | |
| 4,192,212 | 3/1980 | Yamaga et al. . | |
| 4,201,105 | 5/1980 | Alles . | |
| 4,208,939 | 6/1980 | Wangard et al. | 84/1.17 |
| 4,217,804 | 8/1980 | Yamaga et al. . | |
| 4,259,888 | 4/1981 | Gross . | |
| 4,275,634 | 6/1981 | Imamura et al. . | |
| 4,328,732 | 5/1982 | Takeda et al. | 84/1.03 |
| 4,355,559 | 10/1982 | Uya et al. | 84/1.03 |
| 4,437,377 | 3/1984 | Mitarai et al. . | |

FOREIGN PATENT DOCUMENTS

| | | |
|---|---|---|
| 0013490 | 7/1980 | European Pat. Off. . |
| 2362037 | 6/1974 | Fed. Rep. of Germany . |
| 2937256 | 3/1980 | Fed. Rep. of Germany . |
| 3014403 | 10/1980 | Fed. Rep. of Germany . |
| 1483509 | 8/1977 | United Kingdom . |
| 1543958 | 4/1979 | United Kingdom . |
| 2027970 | 2/1980 | United Kingdom . |
| 1595555 | 8/1981 | United Kingdom . |
| 2106694 | 4/1983 | United Kingdom . |

*Primary Examiner*—S. J. Witkowski

*Attorney, Agent, or Firm*—Frishauf, Holtz, Goodman & Woodward

[57] ABSTRACT

A plurality of channels for generating musical tones are provided in LSI chips. A CPU allots a performance mode selected by select switches to the channel or channels. The melody sounds or accompaniment allotted to the channels are generated by a time divisional processing under control of the CPU. The generated sounds are sounded through a loudspeaker, after being subjected to processing by a mixing circuit.

11 Claims, 9 Drawing Figures

FIG. 4
| MODE | LSI 4A | LSI 4B | LSI 4C |
|---|---|---|---|
| OFF | MELODY | MELODY | |
| CONT. RHYTHM | MELODY | CHORD | BASS |
| ARPEGGIO | MELODY | CHORD | BASS ARPEGGIO |
FIG. 5(A)
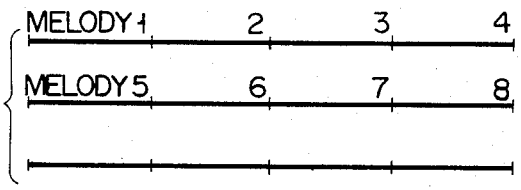
FIG. 5(B)
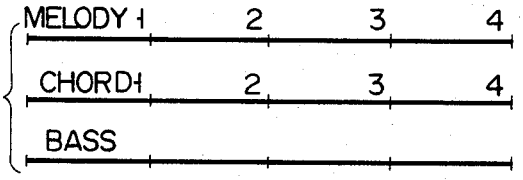
FIG. 5(C)
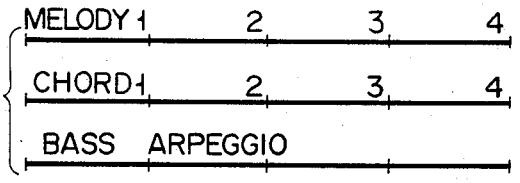

(a) 0 1 2 3 4 5 6 7 8 9 10 11 12 13 14 15

(b) C1 E1 G1 C2 E2 G2 C3 E3 G3 E3 C3 G2 E2 C2 G1 E1

(c) C0 G0

ELECTRONIC MUSICAL INSTRUMENT

This application is a continuation of application Ser. No. 432,998, filed Oct. 6, 1982, and now abandoned.

BACKGROUND OF THE INVENTION

The present invention relates to musical instruments for performing a variety of automatic accompaniments by a time-division processing of a plurality of channels.

Musical instruments capable of performing various automatic accompaniments such as auto chord, auto arpeggio, and auto bass have already been developed. In these prior electronic musical instruments, different automatic accompaniment sounds are produced from generators especially designed for generating particular sounds. These generators further contain their own oscillators. This circuit arrangement makes the circuitry of the prior musical instrument complicated. The oscillators in the different generators, which are designed to produce oscillating signals at the same frequencies to form the same musical tone on the same scale, occasionally produce oscillating signals at slightly different frequencies. When listening to music performed using such a musical instrument, listeners feel the sound is unnatural.

SUMMARY OF THE INVENTION

Accordingly, an object of the present invention is to provide an electronic musical instrument with a simple construction in which various musical tones are equally set on the same musical scale and can produce melody sounds and performance sounds more satisfactorily.

To achieve the above object, there is provided an electronic musical instrument capable of simultaneously producing a plurality of musical tones by processing a plurality of channels in a time divisional manner, the musical instrument comprising a common musical tone generating means which generates accompaniment sounds such as chords, bass and arpeggio together with melody sounds, by controlling channels for generating melody sounds and accompaniment sounds so that allotment of channels is determined according to the type of accompaniment.

BRIEF DESCRIPTION OF THE DRAWINGS

FIG. 4, and FIGS. 5A through 5C illustrate states of channel allotment of melody sounds and accompaniments;

DETAILED DESCRIPTION OF THE PREFERRED EMBODIMENTS

Figure 1:
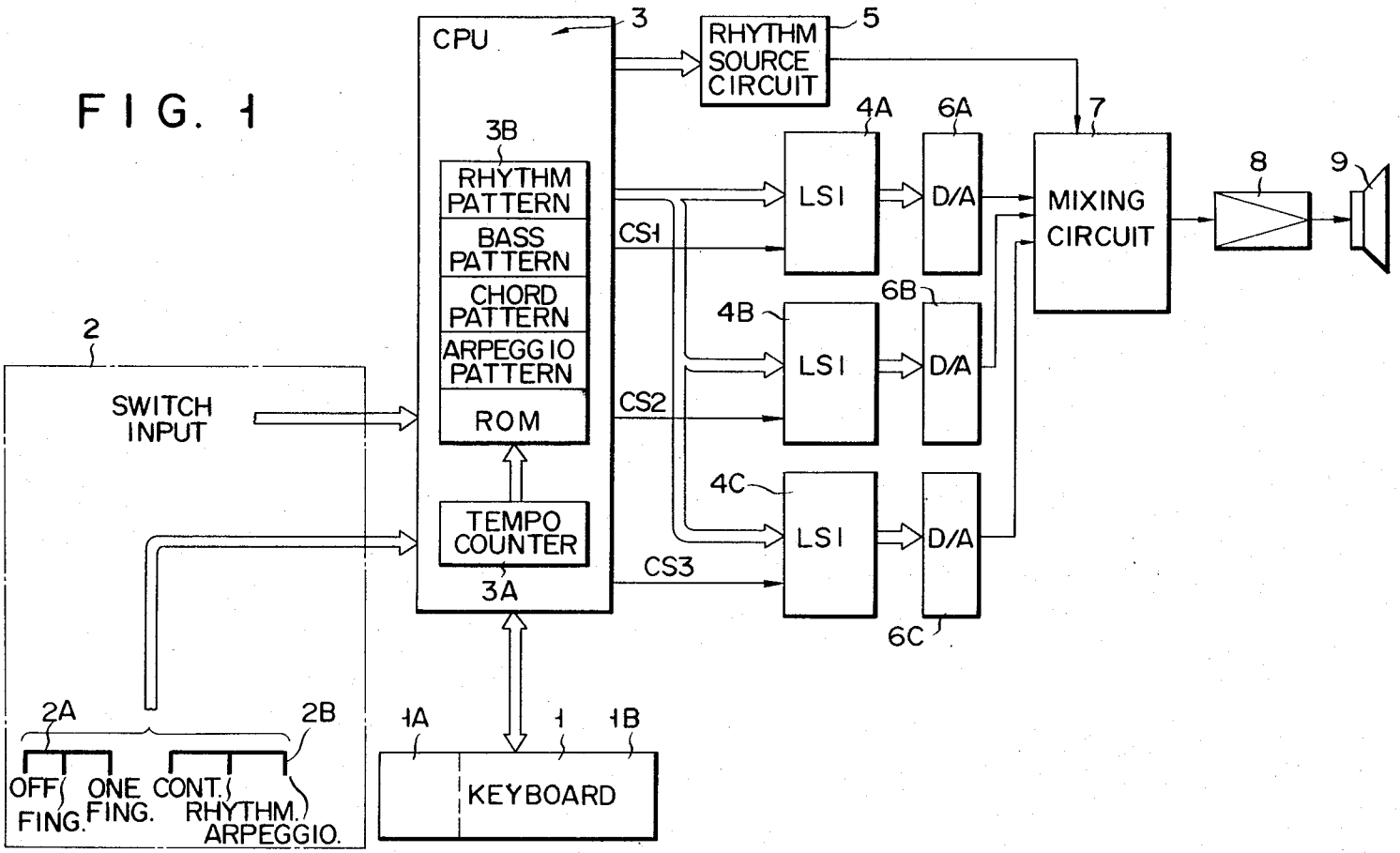
FIG. 1 shows a block diagram of an electronic musical instrument which is an embodiment according to the present invention.

An embodiment of a musical instrument for performing a variety of accompaniments according to the present invention will be described referring to the accompanying drawings. In FIG. 1, a keyboard 1 is mounted on a case of an electronic musical instrument. The keyboard 1 has keys corresponding to five octaves, for example. Of these keys, the keys of the lower two octaves serve as accompaniment keys 1A and the keys of the upper three octaves as melody keys 1B. A switch panel 2 having various types of switches is also provided on the case. A select switch 2A is provided for selecting one of the performance modes. When the select switch 2A is set to an OFF position, the musical instrument allows normal melody performance. When it is set to a position FING, the musical instrument allows a normal chord performance which is conducted by operating the accompaniment keys 1A with three or more fingers. At a position ONE FING of the select switch 2A, the musical instrument allows one-finger performance of chords using one of the accompaniment keys 1A. In the ONE FINGER performance mode, a chord performance of a major chord may be performed by operating a single key for designating only a root key of the accompaniment keys 1A. Further, the chord performances of a minor chord or a 7th chord may be performed by operating the key for designating the root as the lowest sound and another key or two or more keys.

Another select switch 2B is provided having three select positions, CONT., RHYTHM, AND ARPEGGIO. The position CONT. renders the chords under performance continuous. The position RHYTHM renders those chords in time to the rhythm of the music. The position ARPEGGIO performs the chords in an arpeggio manner.

The switch panel 2 is further provided with other various switches for designating various types of rhythms, tones, and the like. These switches are not illustrated since these are not essential to the present invention.

A central processing unit (CPU) 3, made up of a one chip microprocessor, for example, controls all of the operations for the generation of musical sounds. The CPU 3 is connected through a bus line to three LSI chips 4A, 4B and 4C which have the same constructions, and through another bus line to a group of rhythm source circuits 5. For controlling the operation of the musical sound generation, the CPU 3 responds to the switch of the select switch 2A or 2B on the switch panel 2 to produce various types of control signals, and responds to the operation of the keys on the keyboard 1 to produce frequency data corresponding to the musical tones. These control signals and the frequency data are applied to the LSI chips 4A to 4C and the rhythm source circuit 5.

The CPU 3 is provided with a tempo counter 3A and a read only memory (ROM) 3B addressed by the tempo counter 3A. The counting speed of the tempo counter 3A is controlled by a tempo switch (not shown) provided on the switch panel 2. Specifically, the tempo switch changes the output frequency of a VCO (not shown) coupled with the tempo counter 3A. The counter 3A (scale of 16 counters) repeats the counting operation every measure according to a set tempo. The ROM 3B stores a rhythm pattern, a chord pattern, a bass pattern, an arpeggio pattern, and the like, for example. The rhythm pattern read out from the ROM 3B is supplied to the group of rhythm source circuits 5. Then, the rhythm source circuits specified by the rhythm pattern are driven to produce rhythm source signals. The chord pattern is supplied to the LSI chip 4B, for example, under control of the channel allotment of the CPU 3. The chord pattern is subjected to a time division processing to produce corresponding chord sounds. The bass pattern and arpeggio pattern read out from the ROM 3B are sent out after being allotted to channels in the LSI chip 4C, for example. The LSI chip 4C forms bass and arpeggio sounds based on the patterns.

The channels in the LSI chip 4A are allotted for forming melody sounds. The output signals from the LSI chips 4A to 4C are applied to a mixing circuit 7, via corresponding D/A converter circuits 6A to 6C. In the mixing circuit, these output signals are mixed with the rhythm source signals from the rhythm signal source circuits 5. The mixed signal is applied through an amplifier 8 to a loudspeaker 9.

The CPU 3 produces chip select signals CS1 to CS3 to the LSI chips 4A to 4C, with the channel allotment operation. The LSI chips 4A to 4C each has the circuit arrangement shown in FIG. 2. The LSI chips 4A to 4C produce the musical tones forming the melody sound, the chord sound, the bass sound, and the arpeggio sound in the forms of waveform data containing overtones in the order designated by the CPU 3.

Figure 2:
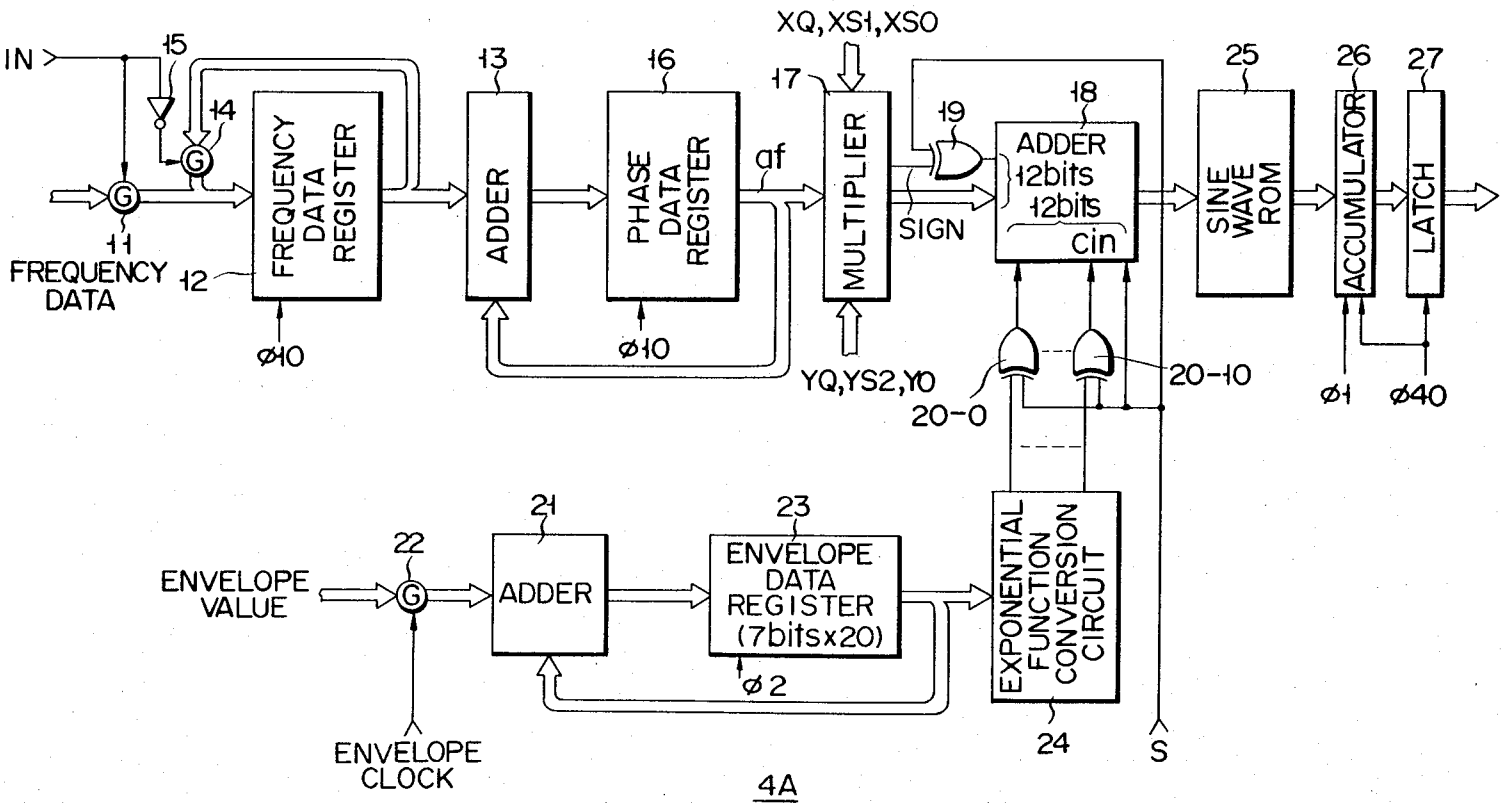
FIG. 2 shows a detailed block diagram of an LSI chip 4A used in the circuit shown in FIG. 1.

A detailed arrangement of a major portion of the LSI chip 4A will be described referring to FIG. 2. The circuit arrangement shown in FIG. 2 is the same as those of the remaining LSI chips 4B and 4C.

The LSI chip 4A is capable of processing four channels by time-division. Each channel corresponds to one musical tone. The LSI chip 4A is capable of generating a maximum of four musical sounds. For this reason, various shift registers such as frequency data registers each contain four shift registers corresponding to the four channels. An envelope data register has 20 shift stages as will be described later.

The frequency data is produced from the CPU 3 according to a scale as given by the operated key on the keyboard and applied to the LSI chip 4A. The frequency data is applied through a gate circuit 11 to a frequency data register 12. The frequency data register 12 is made up of cascade-connected four shift registers each having 20 bits. The shift register 12 is driven by clock signals $\phi$10 (FIG. 3) to perform the shift operation. The frequency data produced from the fourth stage of the shift register is applied to an adder 13 and applied through a gate circuit 14 to the first stage of the shift register of the frequency data register 12. In this case, a control signal IN derived from the CPU 3 is directly applied to the gate circuit 11. Further, the control signal IN is applied through the inverter 15 to the gate circuit 14. Both the gate circuits 11 and 14 are enabled or disabled by these control signals. The control signal IN is a signal of logical "1" at the timing of a channel to which an operated key is allotted. The frequency data for the operated key is applied to the first stage of the frequency data register 12, through the gate circuit 11 which is enabled at this time. At this time, the gate circuit 14 is disabled and hence the feedback of the data from the fourth stage to the first stage of the shift register is blocked. Subsequently, the operated key is turned off. And the control signal IN is produced as a signal of logical "0" at the timing of the channel until the channel is released. As a result, the gate circuit 14 is enabled and the frequency data of the operated key is fed back to the first stage of the shift register. In this way, the frequency data is recirculated in the shift register. Through the recirculation, the frequency data is held in this register.

The adder 13 adds together the frequency data from the frequency data register 12 and the phase data (phase address) fed back from the phase data register 16. The result of the addition is applied as new phase data to a phase data register 16. The phase data register 16 is comprised of four shift registers each having 20 bits, which are connected in a cascade fashion. The phase data register 16 is driven by clock $\phi$10. The phase data produced from the fourth stage shift register of the phase data register 16 is applied to a multiplier 17 and at the same time is fed back to the adder 13. The adder 13 and the phase data register 16 cooperate to accumulate the frequency data and to generate a phase address af.

The multiplier 17 is supplied with control signals XS0, XS1, XQ, YO, YS2, and YQ from the CPU 3. The control signals XS0, XS1 and XQ are applied to an X input terminal of an adder contained in the multiplier 17. Upon receipt of these signals, the multiplier 17 receives the phase address af, the data which is double the phase address af, and the result of the preceding operation. The control signals Y0, YS2 and YQ are applied to a Y input terminal of the adder of the multiplier 17. Upon receipt of these control signals, the multiplier 17 receives the data O, the data four times the phase address af, and the result of the preceding operation. The output data from the multiplier 17 is applied to one input terminal of the adder 18. The most significant bit of the output data (12 bit data) from the multiplier 17 is a SIGN bit representing a sign. The SIGN bit is applied through an exclusive OR gate 19. Envelope data (11 bit data) is applied to a second input terminal of the adder circuit 18, through OR gates 20-10 and 20-0. The detailed construction and operation of the multiplier 17 is described in the specification of U.S. Ser. No. 324,466, filed on Nov. 24, 1981, and now U.S. Pat. No. 4,453,440.

An envelope value is applied to an adder 21, through a gate circuit 22. The envelope value is the data as given under the control of the CPU 3 when the performance key is ON and OFF on the basis of ADSR (attack, decay, sustain, release) preset by external switches. The envelope data is applied to the adder 21 every time an envelope clock is applied to the gate circuit 22 and the gate circuit 22 is enabled.

The adder 21 is supplied with data fed back from the envelope data register. The envelope data register 23 is made up of 20 shift resisters each of 7 bits, and is driven by a clock $\phi$2 (see FIG. 3). In the adder 21, the envelope value and the output data from the envelope data register 23 are added together to form new envelope data (the present value of the envelope), and this is applied to the envelope register 23. The output data from the envelope data register 23, that is, the envelope data, is applied to an exponential function conversion circuit 24. The exponential function converter 24 converts the envelope data into data to provide an ideal envelope waveform of which an attack part of an envelope waveform upwardly curves, the decay part downwardly curves, and the release part downwardly curves. The exponential function conversion circuit may be the converter disclosed in U.S. Ser. No. 324,466, filed on Nov. 24, 1981, now U.S. Pat. No. 4,453,440 filed by the present applicant (corresponding to Japanese Patent Application No. 36595/81). The envelope data produced from the exponential function conversion circuit 24 is applied through the exclusive OR gates 20-10 to 20-0 to the adder 18.

Figure 3:
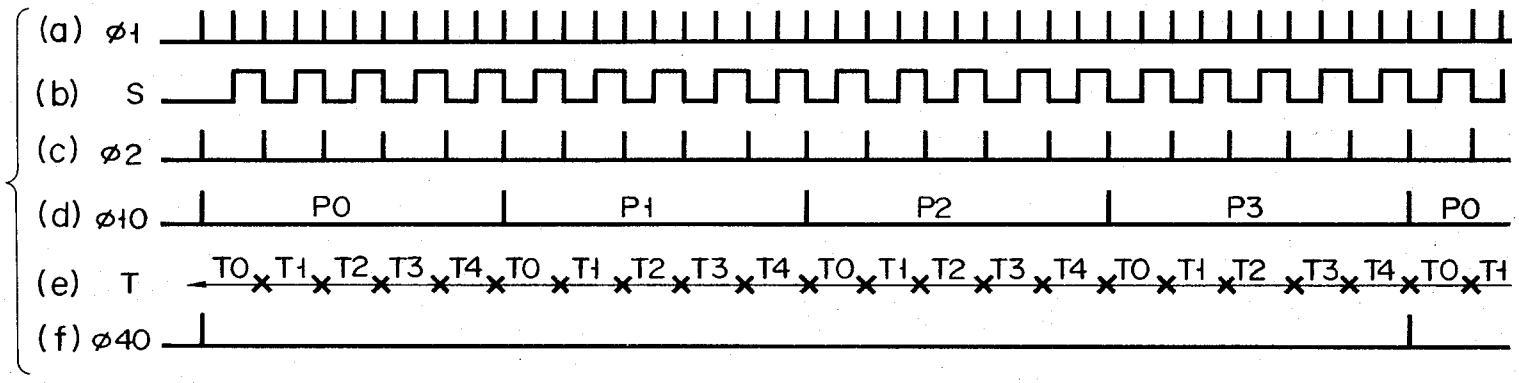
FIG. 3 shows a series of graphic illustrations of the time divisional processing operation of the LSI chip 4A shown in FIG. 2.

The other ends of the exclusive OR gate 19 and the exclusive OR gates 20-10 and 20-0 are supplied with a signal S of which the logical level changes alternately between "1" and "0" every system clock $\phi 1$, as shown in FIG. 3. The signal S is applied to the carrier input terminal Cin of the adder 18.

When the signal S is "0" in logical level, the adder 18 adds together the input data to the first and second input terminals, and applies the result of the addition as address data to a sine wave ROM 25. When the signal S is "1" in logical level, the adder 18 adds together the data formed by inverting only the SIGN bit of the data derived from the multiplier 17 and the data which is the 2's complement of the inverted envelope data from the exponential function converter 24. The adder 18 applies the result of the addition to the sine wave ROM 25. The sine wave produced from the ROM 25 when the signal S is "1" has the same frequency as that of the sine wave read out when the signal S is "0". The phase shift amount of the former is equal to that of the latter but opposite in direction. Further, both the waveforms are of opposite polarities.

Amplitude values of a sine wave at sampling points of $2^n$ (n is a positive integer, for example, 12) are stored in the sine wave ROM 25. The amplitude data read out from the ROM 25 is applied to the accumulator 26 where it is accumulated every system clock $\phi 1$. The accumulated data in the accumulator 26 is latched in the latch 27 at the time that the clock $\phi 40$ is produced (see FIG. 3). Then, the data is applied to the D/A converter 6A. The accumulator 26 is cleared at the timing of the clock $\phi 40$. The accumulated data latched in the latch 27 indicates the accumulation of a maximum of 40 sine waves. In FIG. 3, timings P0, P1, P2 and P3 represent those for the time-divisional operation which is performed every clock $\phi 10$ by the frequency data register 12 and the phase data register 16. Timings T0, T1, T2, T3 and T4 are those for the time-divisional operation which is performed every clock $\phi 2$ at the timings P0 to P2 by those registers.

The LSI chip 4A thus arranged executes the time divisional processing of four channels to produce a maximum of four musical tones. For more details of the LSI chips 4A to 4C, reference is made to U.S. Ser. No. 324,466, filed on Nov. 24, 1981, now U.S. Pat. No. 4,453,440.

The operation of the above-mentioned embodiment will be described referring to FIGS. 4 to 6. For performing only the melody performance, the select switch 2A on the keyboard 1 is set to the OFF position. At this time, the CPU 3 produces chip select signals CS1 and CS2 for selecting only the LSI chips 4A and 4B. For executing the melody performance by operating keys on the keyboard 1, the CPU 3 forms a musical tone generating circuit of a maximum of eight channels, i.e. four channels (first to fourth channels) of the LSI chip 4A and four channels (first to fourth channels) of the LSI chip 4B. A maximum of eight musical tones are concurrently formed and sounded as the melody sound. FIG. 4 and FIG. 5(A) schematically illustrate the OFF mode and the channel allotment as mentioned above. These tables show that the LSI chip 4C is not used in this example. When a desired rhythm is previously designated, the rhythm pattern is read out every measure from the ROM 3B under the address control by the tempo counter 3A, and is applied to the rhythm source circuit 5. Then, the rhythm source circuit 5 generates the rhythm sound which in turn is sounded together with the melody sound. The generation of the rhythm sound is correspondingly applied to those of the remaining modes to be described later.

Let us consider another example in which automatic performances such as auto chord and auto bass are performed with the melody performance using the keyboard 1. For executing the performances, the select switch 2A is set to the position FING or ONE FING, and the select switch 2B is set to the position CONT. or RHYTHM. At this time, the CPU 3 transfers chip select signals CS1 to CS3 to the LSI chips 4A to 4C, thereby controlling the allotment of the channels to the musical tones. The melody performance using the keyboard 1 is allotted to four channels (first to fourth channels) of the LSI chip 4A under the channel control by the CPU 3. Thus, a maximum of four musical tones are generated as a melody sound. The auto chord performance is allotted to the four channels (first to fourth channels) of the LSI chip 4B. Thus, a maximum of four musical tones are produced as an auto chord sound. The auto bass performance is allotted to only one channel (first channel) of the LSI chip 4C, so that only one sound is generated as an auto bass sound. This channel allotment is schematically illustrated in the CONT. RHYTHM mode shown in FIGS. 4 and 5(B). For generating the auto chord sound, an accompaniment key on the keyboard 1 is operated to read out a chord pattern from the ROM 3B and is applied to the LSI chip 4B. For generating the auto bass sound, a bass pattern is read out from the ROM 3B and is applied to the LSI chip 4C. Since the ROM 3B is address-controlled by a single tempo counter 3A, the auto chord sound, the auto bass sound and the rhythm sound are synchronized with one another at the same tempo.

Figures 6A, 6B:
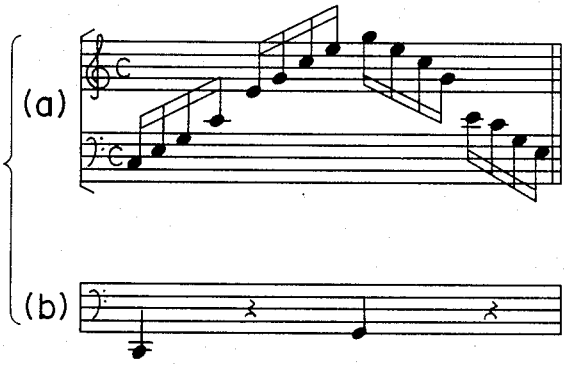
FIG. 6A shows a relationship between arpeggio and bass.
FIG. 6B shows change of arpeggio and bass on a score.

The explanation which follows is for a case in which the arpeggio performance is performed with the melody performance by the keyboard and the automatic performance such as the auto chord and auto bass. The select switch 2A is set to the position FING or ONE FING. The select switch 2B is set to the position ARPEGGIO. The channel allotment in this case is illustrated by the ARPEGGIO mode as shown in FIG. 4 and FIG. 5(C). As shown, the arpeggio performance is alloted to the second channel of the LSI chip 4C, in addition to the channel allotments of the melody performance and the automatic performances of the auto chord and auto bass. An arpeggio pattern is read out from the ROM 3B synchronously with the rhythm pattern, the chord pattern, the bass pattern, and the like. The read-out pattern is applied to the second channel of the LSI chip 4C, thereby forming an arpeggio sound. FIGS. 6(A) and 6(B) show examples of the arpeggio sound and the auto bass sound in the case of a C major chord. Simultaneously with the melody performance, the auto performances such as auto chord, auto bass, and arpeggio are executed under the channel control of the CPU 3.

While the above-mentioned embodiment employs three LSI chips for generating the musical tones by the time divisional processing manner, the number of the LSI chips may be varied if the LSI chip has a plurality of time-divisional processing channels. In an extreme case, one LSI chip, for example, may be used. The channel allotment of the melody performance and the automatic performances such as auto chord, auto bass and arpeggio are not limited by the above-mentioned channel allotment. Accordingly, the automatic performance may take any form of the performances. The reproduced chord, bass and arpeggio may take proper patterns.

As described above, there has been proposed an electronic musical instrument capable of simultaneously producing a plurality of musical sounds by processing a plurality of channels in a time divisonal manner, the musical instrument comprising a common musical sound generating means which generates accompaniment sounds such as chord, bass and arpeggio together with melody sounds, by controlling channels for generating melody sounds and accompaniment sounds so that allotment of the channels are determined according to the type of an accompaniment. With such an arrangement, the circuit construction of the musical instrument is simple. When the musical tone generating means is used, a fundamental oscillator may be used for both the melody sound and the accompaniment. This successfully solves the problem involved in the prior art that the fundamental frequency for the melody sound differs slightly from that of the accompaniment sound.

What is claimed is:

1. An electronic musical instrument comprising:

a keyboard having a plurality of keys, said keys including keys for performing at least one of a melody and an accompaniment;

at least one musical tone signal generating means having a plurality of tone signal generating channels, said tone signal generating channels being switchable on a time division basis, each tone signal generating channel producing a musical tone signal, said musical tone signal generating means including means for generating one or more of the musical tone signals simultaneously;

manual switch means for selecting a performance mode using the musical tone signals generated by said musical tone signal generating means;

said manual switch means including means for selecting at least one of chord, bass and arpeggio as an accompaniment; and channel control means for allotting tones corresponding to at least one of melody and accompaniment determined by key operations on said keyboard to different ones of said tone signal generating channels depending on a performance mode selected by said manual switch means, said channel control means allotting tones of the melody to at least one of said tone generating channels in one performance mode selected by said manual switch means, and allotting tones of the accompaniment to said at least one of said tone generating channels in another performance mode selected by said manual switch means.

2. An electronic musical instrument according to claim 1, wherein each of said at least one musical tone signal generating means includes an LSI coupled with said channel control means.

3. An electronic musical instrument according to claim 2, wherein said performance mode selecting means includes switch means for selecting either a melody performance or an accompaniment performance.

4. An electronic musical instrument according to claim 3, wherein said performance mode selecting means includes means for selecting at least one musical tone signal of a chord sound, a bass sound and an arpeggio sound on a time division basis in a channel selectively allotted by said channel control means.

5. An electronic musical instrument according to claim 3, wherein said channel control means includes a CPU which receives a key operation signal generated from said keyboard and a switch signal from said switch means, and includes means for sending a chip select signal to an LSI according to a selected accompaniment mode, and for specifying a given channel in said selected LSI.

6. An electronic musical instrument according to claim 5, further comprising musical sound generating means including a mixing circuit commonly connected to output terminals of said LSIs, an amplifier for amplifying an output signal from said mixing circuit, and a loudspeaker coupled to an output of said amplifier.

7. An electronic musical instrument according to claim 1, wherein said performance mode selecting means includes switch means for selecting either a melody performance or an accompaniment performance.

8. An electronic musical instrument according to claim 1, wherein each of said tone signal generating channels produces a musical tone signal from frequency information and envelope information.

9. An electronic musical instrument according to claim 1, wherein said channel control means allocates tones corresponding to both said melody and accompaniment, as performed by key operations on said keyboard, to different ones of said tone signal generating channels.

10. An electronic musical instrument comprising:

a musical tone generating means having a plurality of tone signal generating channels, said musical tone generating means including means for simultaneously producing a plurality of musical tones by processing said plurality of tone signal generating channels in a time division manner, said musical tones being generated from at least frequency information;

performance type selecting means including means for manually selecting an accompaniment which includes at least one of chord, bass and arpeggio;

channel control means coupled to said musical tone generating means and to said performance type selecting means for controlling said tone signal generating channels for generating at least selected accompaniment tones; and said channel control means includes allotment means for allotting said tone signal generating channels in said time division manner depending on a type of accompaniment selected by said performance type selecting means, whereby said channel control means allots tones of a melody to at least one of said tone generating channels in one performance type selected by said performance type selecting means and allots tones of the accompaniment to said at least one of said tone generating channels in another performance type selected by said performance type selecting means.

11. An electronic musical instrument according to claim 10, wherein each of said tone signal generating channels produces a musical tone signal from both frequency information and envelope information.

* * * * *